US010815840B2

(12) United States Patent
Foster et al.

(10) Patent No.: US 10,815,840 B2
(45) Date of Patent: Oct. 27, 2020

(54) COUPLING ASSEMBLY FOR SWITCHABLE LEVER

(71) Applicant: Schaeffler Technologies AG & Co. KG, Herzogenaurach (DE)

(72) Inventors: Colin Foster, Belle River (CA); David Chandler, Windsor (CA)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 16 days.

(21) Appl. No.: 15/997,839

(22) Filed: Jun. 5, 2018

(65) Prior Publication Data

US 2019/0368386 A1 Dec. 5, 2019

(51) Int. Cl.
*F01L 1/18* (2006.01)
*F01L 13/00* (2006.01)

(52) U.S. Cl.
CPC ..... *F01L 1/185* (2013.01); *F01L 13/0005* (2013.01); *F01L 2001/186* (2013.01)

(58) Field of Classification Search
CPC .. F01L 1/185; F01L 13/0005; F01L 2001/186
USPC ..... 60/90.39; 123/90.41, 90.43
See application file for complete search history.

(56) References Cited

U.S. PATENT DOCUMENTS

| | | | | |
|---|---|---|---|---|
| 6,502,536 | B2 * | 1/2003 | Lee | F01L 1/185 123/90.16 |
| 2010/0300389 | A1 * | 12/2010 | Manther | F01L 1/185 123/90.39 |
| 2011/0126787 | A1 | 6/2011 | Kirbach | |
| 2011/0197842 | A1 | 8/2011 | Manther et al. | |
| 2012/0138002 | A1 * | 6/2012 | Tsuzuki | F01L 1/185 123/90.18 |
| 2014/0083380 | A1 * | 3/2014 | Hiramatsu | F01L 1/185 123/90.15 |
| 2017/0183982 | A1 * | 6/2017 | Hughes | F01L 1/185 |
| 2019/0284967 | A1 * | 9/2019 | Hiramatsu | F01L 1/462 |
| 2019/0316494 | A1 * | 10/2019 | Mariuz | F01L 1/22 |
| 2019/0376420 | A1 * | 12/2019 | Elendt | F01L 1/185 |

FOREIGN PATENT DOCUMENTS

| | | | |
|---|---|---|---|
| WO | 2019007453 A1 | 1/2019 | |
| WO | WO-2019007453 A1 * | 1/2019 | F01L 13/0036 |

* cited by examiner

*Primary Examiner* — Devon C Kramer
*Assistant Examiner* — Kelsey L Stanek
(74) *Attorney, Agent, or Firm* — Matthew V. Evans

(57) ABSTRACT

A switchable lever is provided that includes an outer lever, an inner lever pivotably mounted to the outer lever, and a coupling assembly capable of selectively locking the inner lever to the outer lever. The coupling assembly is arranged to be actuated from either a first side or a second side of the switchable lever. The coupling assembly can have one or more push pins and a coupling pin that is arranged to be actuated by the one or more push pins. An actuated end of the coupling pin can be formed with a receiving land that is configured to engage a cam form on a second end of the one or more push pins.

20 Claims, 6 Drawing Sheets

COUPLING ASSEMBLY FOR SWITCHABLE LEVER

TECHNICAL FIELD

This invention is generally related to levers, and, more particularly, to switchable levers utilized within a valve train of an internal combustion (IC) engine.

BACKGROUND

Levers are utilized within valve trains of IC engines to facilitate translation of rotary motion of a camshaft to linear motion of an intake or exhaust valve. Switchable levers can include a coupling assembly that can couple or uncouple an inner lever to an outer lever to achieve different discrete valve lifts. The coupling assembly can be actuated by hydraulic fluid which can require a series of hydraulic fluid galleries arranged throughout an engine. The coupling pin can also be actuated by an electric actuator. Use of an electric actuator instead of actuation by hydraulic fluid can offer several advantages including, but not limited to, wider operating temperature range, elimination of hydraulic fluid oil galleries, and faster actuation times. Packaging space within an IC engine can be very limited for switchable lever systems.

SUMMARY

A switchable lever is provided that includes an outer lever, an inner lever pivotably mounted to the outer lever, and a coupling assembly capable of selectively locking the inner lever to the outer lever. The coupling assembly is arranged to be actuated from either a first side or a second side of the switchable lever. The coupling assembly can have one or more push pins and a coupling pin that is arranged to be actuated by the one or more push pins. The coupling assembly can also have an optional bias spring to assist with positional control of the coupling pin. An actuated end of the coupling pin can be formed with a receiving land that is configured to engage a cam form on a second end of the one or more push pins. The receiving land can be a pin, or any other form that is suited to engage a cam form of the push pin(s). Moving directionally from the second end to a first end of the push pin(s), a portion of the cam form can have an increasing width. The coupling pin can have a first locking surface on an end opposite the actuated end. A coupling pin projection can also be arranged on the coupling pin to include the first locking surface.

The push pin(s) can be arranged to move longitudinally within a first bore and the coupling pin can be arranged to move longitudinally within a second bore. Both of these bores can be included within the outer lever. The second bore can intersect the first bore. The first bore can form an angle with the second bore that ranges from 85 to 95 degrees.

In an example embodiment, a coupling assembly includes a first push pin and a second push pin that are arranged to move longitudinally within a first bore. The first push pin and the second push pin can be horizontally opposed within the first bore. The coupling assembly can be moveable from a first, locked position to a second, unlocked position. One or both of these two positions can be achieved by moving the first push pin within the first bore in a first direction or by moving the second push pin within the first bore in a second direction that is opposite the first direction.

In an example embodiment, a switchable lever system is provided that includes one or more switchable levers and one or more actuators that are arranged to actuate the switchable lever(s). The one or more switchable levers includes an outer lever, an inner lever that is pivotably mounted to the outer lever, and a coupling assembly that is arranged to be actuated from either a first side or a second side of the at least one switchable lever.

BRIEF DESCRIPTION OF THE DRAWINGS

The above mentioned and other features and advantages of the embodiments described herein, and the manner of attaining them, will become apparent and better understood by reference to the following descriptions of multiple example embodiments in conjunction with the accompanying drawings. A brief description of the drawings now follows.

DETAILED DESCRIPTION OF THE EMBODIMENTS

Figure 1:
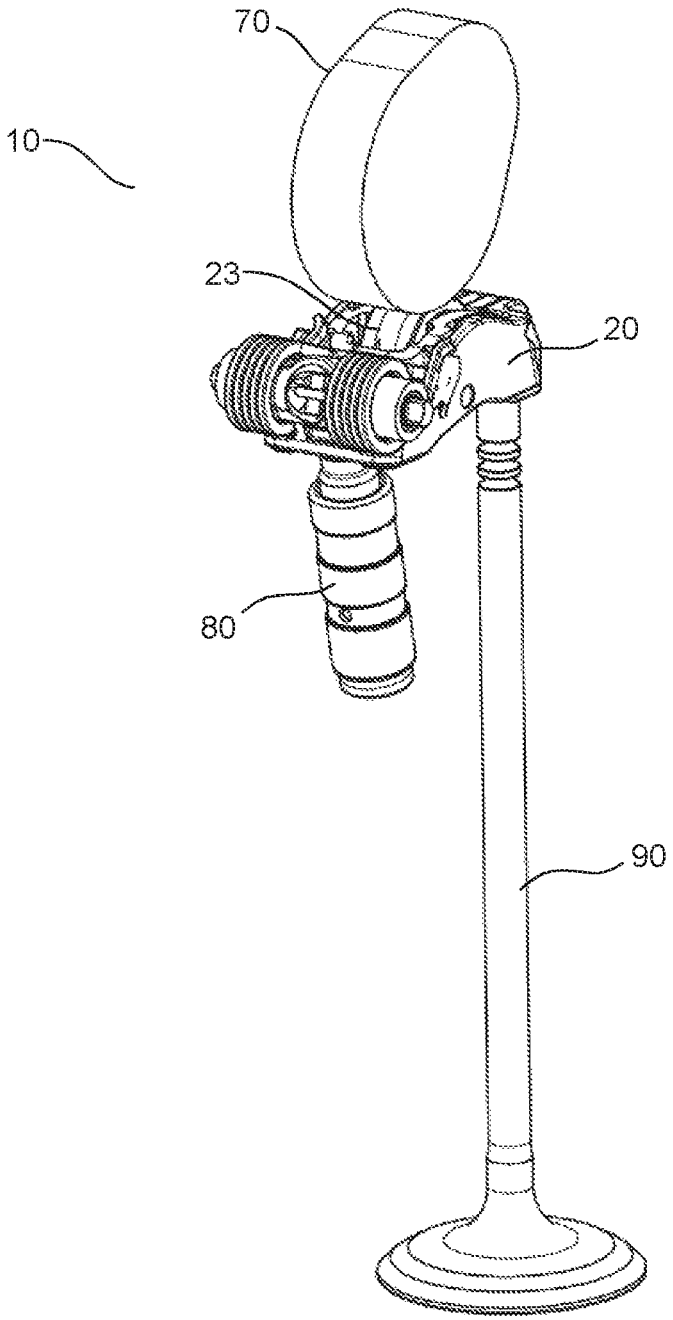
FIG. 1 is a perspective view of a valve train system for an IC engine that includes a camshaft, a hydraulic lash adjuster, an engine valve, and a switchable lever.

Identically labeled elements appearing in different figures refer to the same elements but may not be referenced in the description for all figures. The exemplification set out herein illustrates at least one embodiment, in at least one form, and such exemplification is not to be construed as limiting the scope of the claims in any manner. Certain terminology is used in the following description for convenience only and is not limiting. The words "inner," "outer," "inwardly," and "outwardly" refer to directions towards and away from the parts referenced in the drawings. Axially refers to directions along a diametric central axis. Radially refers to directions that are perpendicular to the central axis. The words "left", "right", "up", "upward", "down", and "downward" designate directions in the drawings to which reference is made. The terminology includes the words specifically noted above, derivatives thereof, and words of similar import.

Referring to FIG. 1, a perspective view of a switchable lever 20 is shown within a valve train system 10 of an IC engine (not shown) that includes a camshaft 70, a hydraulic pivot element 80, and an engine valve 90. A non-hydraulic or mechanical pivot element could also be utilized within the valve train system 10. The camshaft 70 actuates the switchable lever 20 through a roller 23 interface about the hydraulic pivot element 80, causing rotational lift provided by the camshaft 70 to be translated to linear lift of the engine valve 90. A single "valve event" is facilitated by one rotation of the camshaft 70, encompassing opening and closing of the engine valve 90.

Referring now to FIGS. 1 through 5B, a detailed explanation of the design and function now follows for the switchable lever 20. The switchable lever 20 includes an outer lever 24 pivotably connected to an inner lever 22 by a pivot axle 26. The outer lever 24 has two outer arms 29A, 29B that extend along respective longitudinal sides 27A, 27B of the inner lever 22. A cavity 21 within the inner lever 22 houses the roller 23 that interfaces with the camshaft 70 shown in FIG. 1. The roller 23 is connected to the inner lever 22 via a transverse axle pin 31 disposed within two axle apertures (not shown) of the inner lever 22. Optional needle rollers 44 can be arranged between the roller 23 and the axle pin 31. Lost motion resilient elements or springs 28A, 28B are arranged on respective lost motion spring posts 39A, 39B of the outer lever 24. The lost motion springs 28A, 28B are arranged to apply an upward force against lost motion spring landings 41A, 41B located on the inner lever 22 to bias the roller 23 of the inner lever 22 to an upper-most position.

Figure 4A:
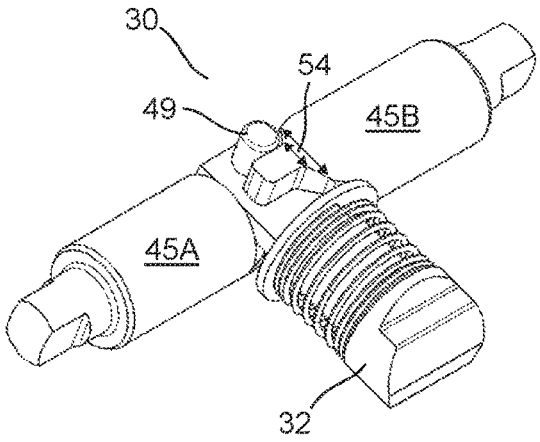
FIG. 4A is a perspective view of the coupling assembly of FIG. 3 in a first, locked position.
Figure 4B:
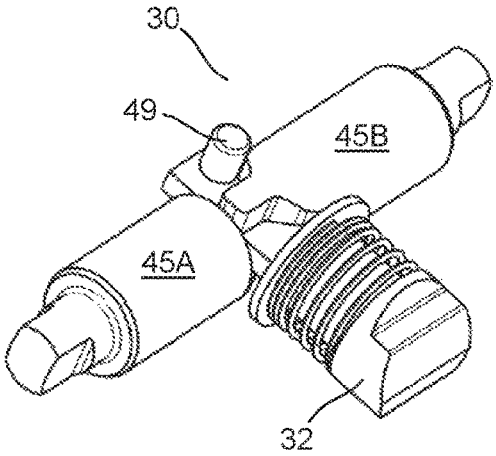
FIG. 4B is a perspective view of the coupling assembly of FIG. 3 in a second, unlocked position.
Figure 4C:
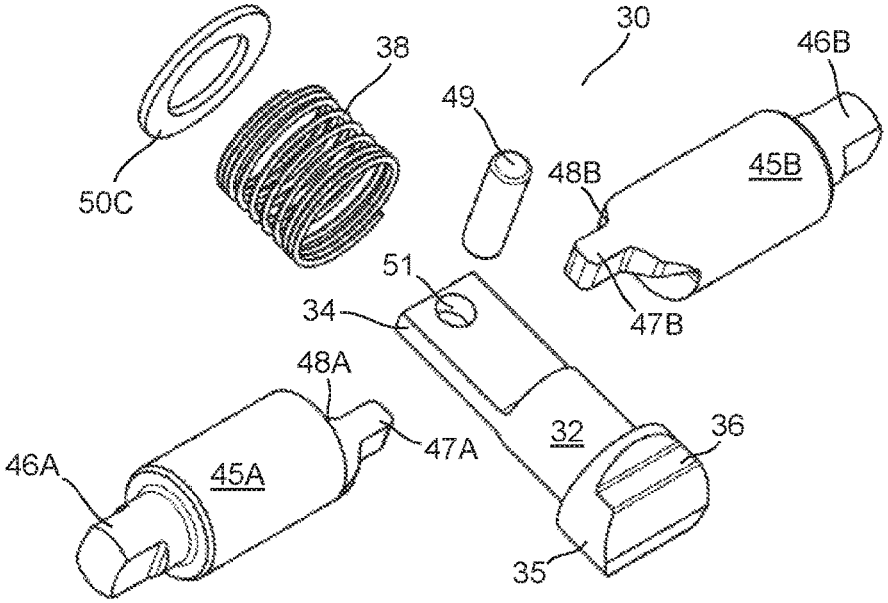
FIG. 4C is an exploded perspective view of the coupling assembly of FIGS. 4A and 4B.
Figure 5A:
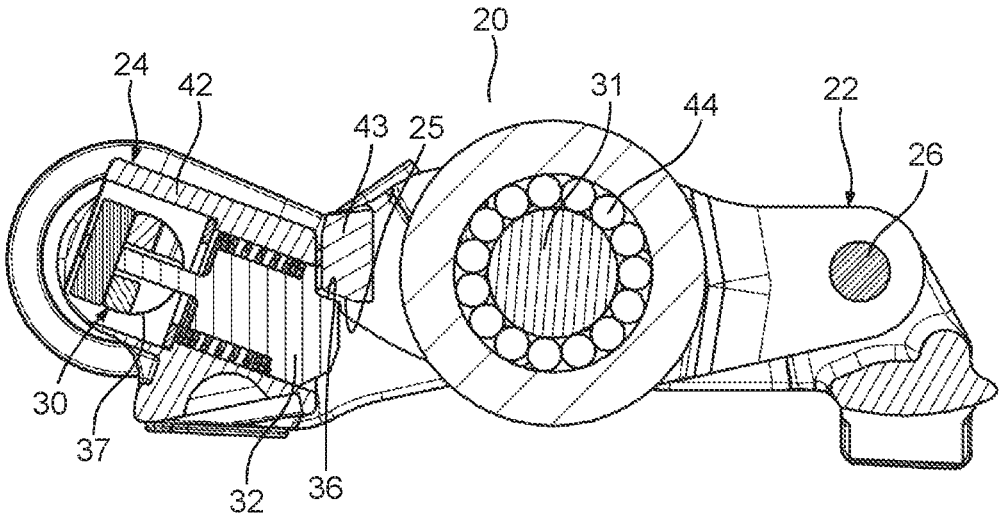
FIG. 5A is a cross-sectional view of the switchable lever of FIG. 2 in the first, locked position.
Figure 5B:
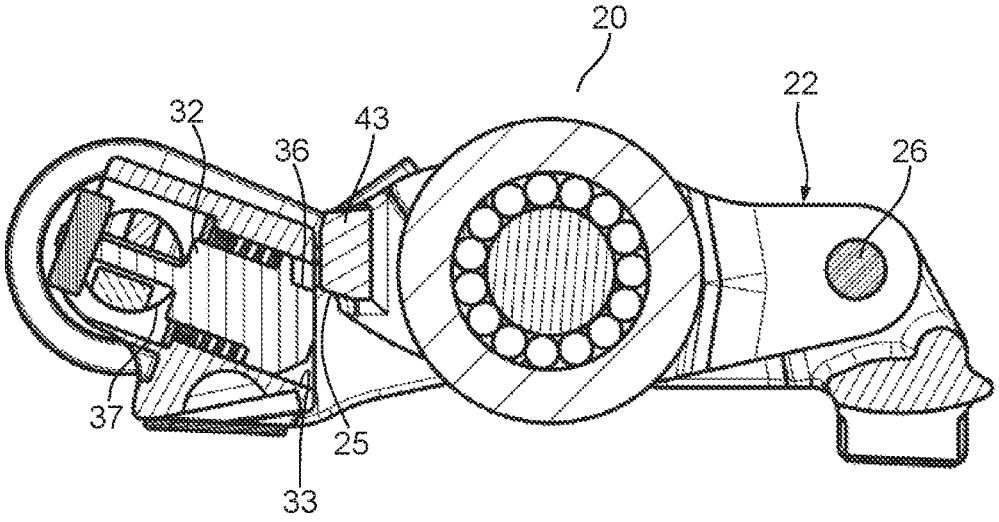
FIG. 5B is a cross-sectional view of the switchable lever of FIG. 2 in the second, unlocked position.

With reference to FIGS. 4A through 5B, a locking end 42 of the outer lever 24 is configured with a coupling assembly 30 that can selectively lock the inner lever 22 to the outer lever 24, achieving two different valve lift modes. A first, locked position of the coupling assembly 30 is shown in FIGS. 4A and 5A and a second, unlocked position of the coupling assembly 30 is shown in FIGS. 4B and 5B.

Figure 3:
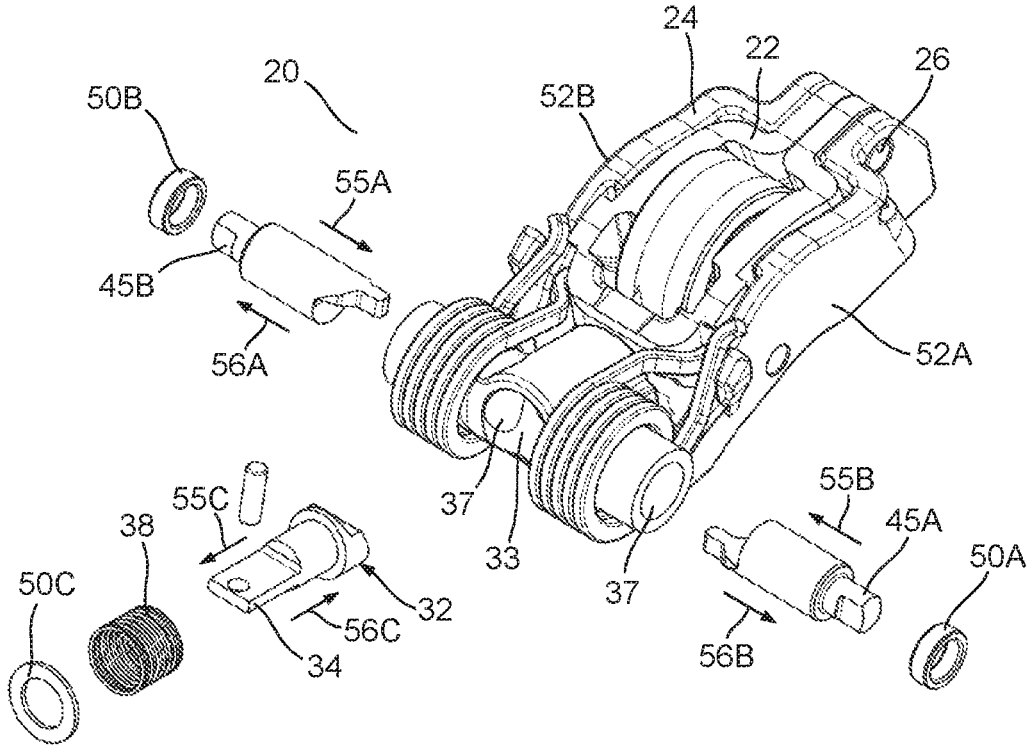
FIG. 3 is an exploded perspective view of the switchable lever of FIG. 2 that shows an example embodiment of a coupling assembly.

In an example embodiment, the coupling assembly 30 includes a first push pin 45A, a second push pin 45B, a coupling pin 32, and an optional bias spring 38. The bias spring 38 can assist with positional control of the coupling pin 32. The first push pin 45A and the second push pin 45B move longitudinally within a first bore 37 and the coupling pin 32 moves longitudinally within a second bore 33. It could also be possible that the first push pin 45A and the second push pin 45B move longitudinally within separate bores. Both the first bore 37 and the second bore 33 can be arranged within the outer lever 24. The first bore 37 can be generally perpendicular with the second bore 33. "Generally perpendicular" can be defined as an angle between the first bore 37 and the second bore 33 that ranges from 85 to 95 degrees. However, angles outside of this range are also possible. As shown in FIG. 3, the first bore 37 can be intersected by the second bore 33. A first retainer 50A, a second retainer 50B, and a third retainer 50C can retain the coupling assembly 30 within the respective first and second bores 37, 33. Different forms for the first, second, and third retainers 50A, 50B, 50C, other than what is shown, are possible.

Figure 2:
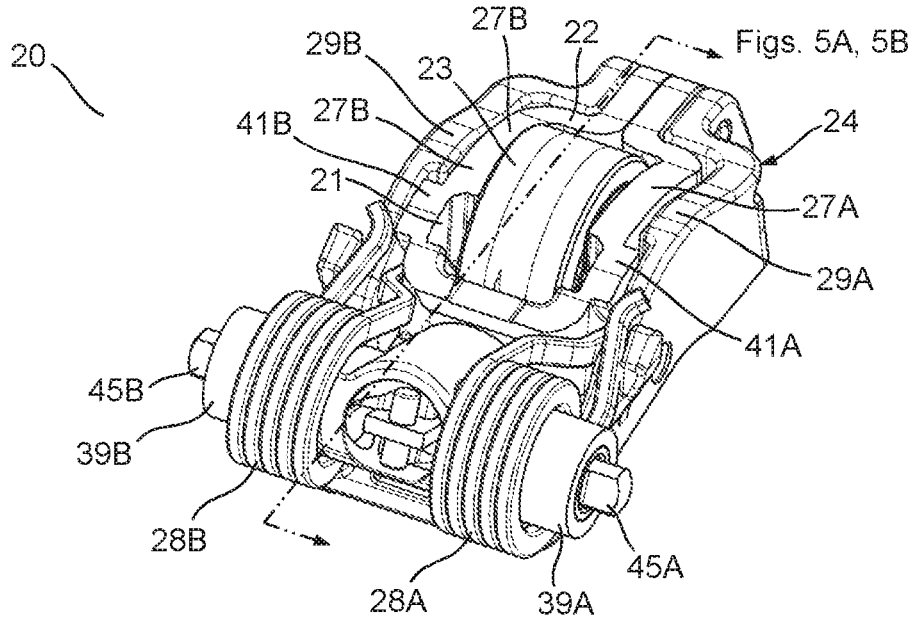
FIG. 2 is a perspective view of the switchable lever of FIG. 1.

As shown in FIGS. 2 and 3, the first push pin 45A and the second push pin 45B can be arranged such that they are horizontally opposed with respect to each other within the first bore 37. When the first push pin 45A is displaced longitudinally within the first bore 37 in a first direction (shown by direction arrows 55A and 56A), or the second push pin 45B is displaced longitudinally inward within the first bore 37 in a second direction (shown by direction arrows 55B and 56B), opposite the first, longitudinal displacement of the coupling pin 32 in a third direction (shown by direction arrows 55C and 56C) within the second bore 33 occurs. Stated otherwise, linear motion of either the first push pin 45A or the second push pin 45B can be translated to linear motion of the coupling pin 32. For example, when the first push pin 45A is displaced in the first direction shown by direction arrow 55A (longitudinally inward) or the second push pin 45B is displaced in the second direction, opposite the first, shown by direction arrow 55B (also longitudinally inward), the coupling pin 32 can move in the third direction shown by direction arrow 55C, unlocking the inner lever 22 from the outer lever 24 and achieving the second, unlocked position. While in the second unlocked position, if the first push pin 45A is displaced in the first direction shown by direction arrow 56A (longitudinally outward) or the second push pin 45B is displaced in the second direction, opposite the first, shown by direction arrow 56B (also longitudinally outward), the coupling pin 32 can move in the third direction shown by direction arrow 56C, locking the inner lever 22 to the outer lever and achieving the first, locked position. As the first bore 37 is generally perpendicular with the second bore 33, the first and second push pins 45A, 45B are also generally perpendicular with the coupling pin 32. The translation of motion from either of the first or second push pins 45A, 45B to the coupling pin 32 is accomplished by a cam-type interface between the first and second push pins 45A, 45B and the coupling pin 32. As shown in FIG. 4C, a second end 47A of the first push pin 45A is configured with a first cam form 48A that interfaces with a receiving land 49 arranged at an actuated end 34 of the coupling pin 32. The receiving land 49 is formed as a pin and is received by an aperture 51, however, any form and attachment method that is suitable for functioning as a receiving land for the first and second push pins 45A, 45B is possible. The first cam form 48A can have any shape that translates motion of the first push pin 45A to motion of the coupling pin 32. As with the first push pin 45A, a second end 47B of the second push pin 45B is configured with a second cam form 48B to interface with the receiving land 49 of the coupling pin 32. In an example embodiment, the second cam form 48B is increasing in width 54 (shown in FIG. 4A), moving directionally from the second end 47B to the first end 46B. With this described arrangement of the coupling assembly 30, the switchable lever 20 can be actuated from either a first side 52A or a second side 52B, as shown in FIG. 3.

FIG. 4A shows a first, locked position and FIG. 4B shows a second, unlocked position for the coupling assembly 30. Given the increasing width 54 of the second cam form 48B of the second push pin 45B, as the second push pin 45B is moved longitudinally inward, the second cam form 48B interfaces with the receiving land 49 to move the coupling pin 32 to a retracted or second, unlocked position.

With reference to FIGS. 1 and 5A, the coupling pin 32 is shown in the first, locked position in which the inner lever 22 and the outer lever 24 pivot in unison about the hydraulic pivot element 80, resulting in a first valve lift mode. The first, locked position is enabled when the coupling pin 32 is in an extended position such that a first locking surface 36 of the coupling pin 32 becomes engaged with a second locking surface 25 on a lost motion end 43 of the inner lever 22 when the switchable lever 20 is loaded during a valve event.

With reference to FIG. 4C, the coupling pin 32 is shown configured with an optional coupling projection 35, at an end opposite the actuated end 34, which can provide a stop for the optional bias spring 38. The preferred material of the coupling pin 32 is steel, but other suitable materials are also possible. The first locking surface 36 is configured on the coupling projection 35 as a flat but can be of any suitable form for such a locking function.

Now referencing FIGS. 1 and 5B, the coupling pin 32 is shown in the second, unlocked position. In this state, the inner lever 22 is allowed to rotate about the pivot axle 26 during each camshaft 70 rotation, resulting in an arcuate motion of the inner lever 22, often termed lost motion, while the outer lever 24 remains stationary. The second, unlocked position is enabled when the coupling pin 32 is in a retracted position such that no portion of the first locking surface 36 of the coupling pin 32 can engage with the second locking surface 25 of the inner lever 22 during a valve lift event. The second, unlocked position facilitates a second valve lift mode.

Figure 6A:
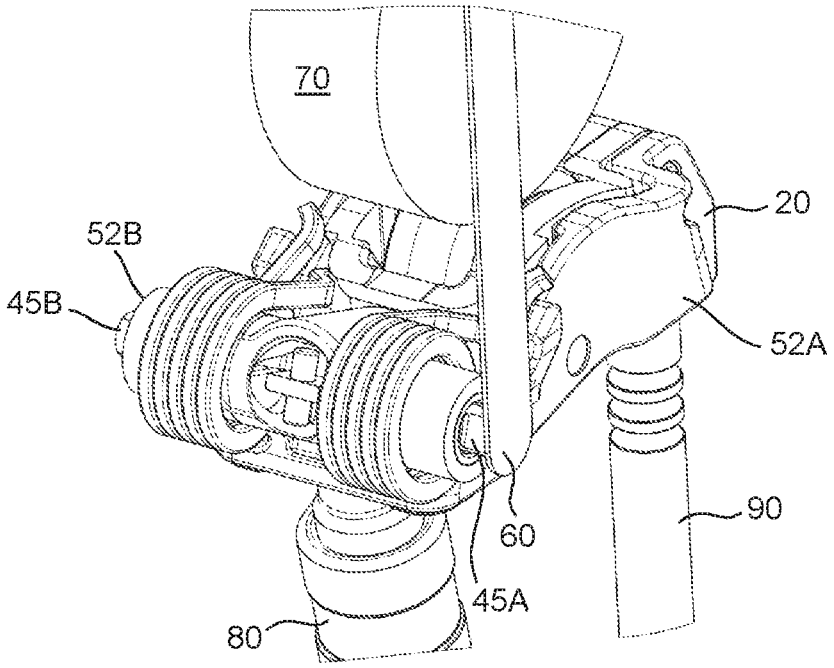
FIG. 6A is a perspective view of a switchable lever with an actuator located on a first side of the switchable lever.
Figure 6B:
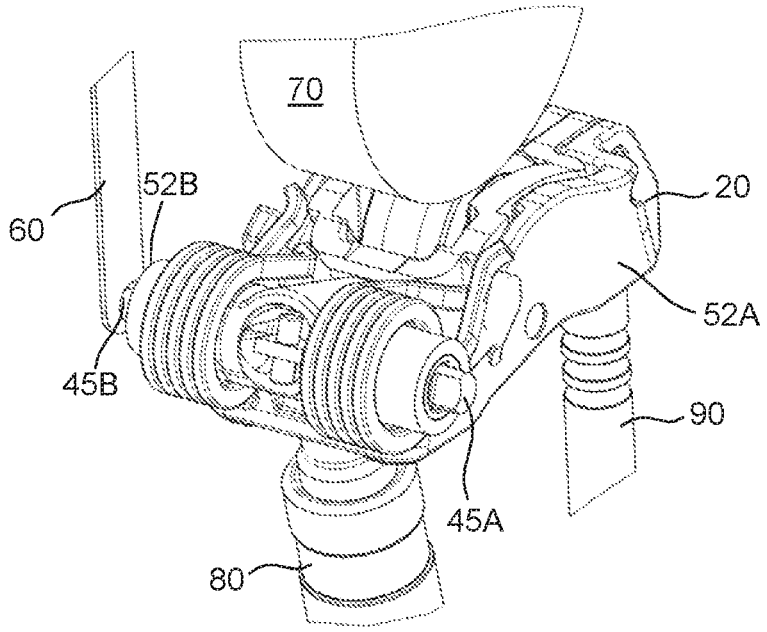
FIG. 6B is a perspective view of a switchable lever with an actuator located on a second side of the switchable lever.
Figure 7:
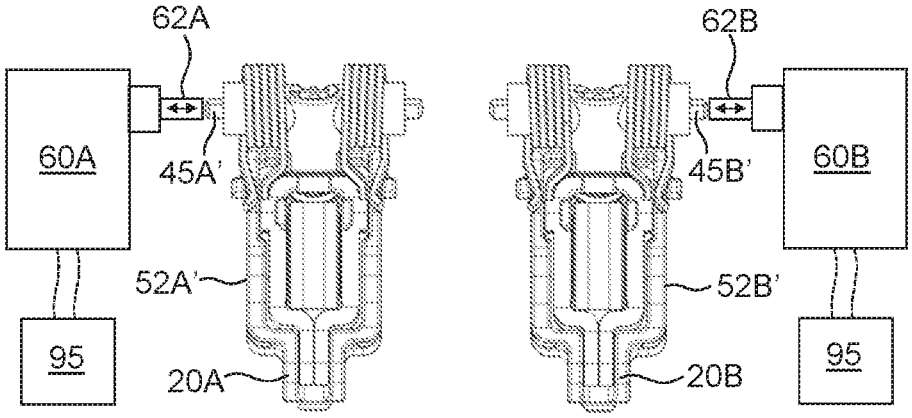
FIG. 7 is a top view of a first switchable lever, a second switchable lever, a first actuator, a second actuator, and an electronic controller.

FIGS. 6A, 6B, and 7 illustrate three switchable lever and actuator arrangement scenarios that represent a fraction of what are possible, given the versatility of the previously described switchable lever 20 that can be actuated from either the first side 52A or the second side 52B. The term "actuator" is intended to define a component, or assembly of components that actuates the switchable lever 20 (or levers). Referring to FIG. 6A with view to FIG. 4C, an actuator 60 is arranged to engage a first end 46A of the first push pin 45A. Thus, the actuator 60 actuates the coupling assembly 30 from the first side 52A of the switchable lever 20. Now referring to FIG. 6B with view to FIG. 4C, the actuator 60 is arranged to engage a first end 46B of the second push pin 45B. Thus, the actuator 60 actuates the coupling assembly 30 from the second side 52B of the switchable lever 20. Given the arrangements of FIGS. 6A and 6B, the actuator 60 could be arranged to actuate more than one switchable lever, if desired. It could be possible to eliminate either the first push pin 45A or the second push pin 45B within the switchable lever 20, depending on whether the actuator 60 is arranged on the first side 52A or the second side 52B of the switchable lever 20. Therefore, for a given IC engine, some switchable levers 20 may have only a first push pin 45A and the remaining switchable levers may only have a second push pin 45B.

Referring to FIG. 7, a first switchable lever 20A and a second switchable lever 20B are shown together with a first actuator 60A and a second actuator 60B. The first actuator 60A has a first actuator pin 62A that engages a first push pin 45A' of the first switchable lever 20A, and the second actuator 60B has a second actuator pin 62B that engages the second push pin 45B' of the second switchable lever 20B. Thus, the first actuator 60A actuates the first switchable lever 20A from a first side 52A' and the second actuator 60B actuates the second switchable lever 20B from a second side 52B'. It may also be possible to have a single actuator that actuates both the first and second switchable levers 20A, 20B. In the arrangement of FIG. 7, the first side 52A' is opposite the second side 52B', and the first side 52A' and the second side 52B' can be described as longitudinal sides; however, these descriptions of the first side 52A' and the second side 52B' do not always need to hold true, as many different forms of coupling assemblies are possible along with their fitment within a switchable lever.

FIG. 7 also includes an electronic controller 95 that can control actuation, and the timing thereof, through electronic communication with the actuator 50. Multiple electronic controllers can also be present instead of the single electronic controller 95. Furthermore, the electronic controller 95 can be that of an engine control unit which controls an IC engine.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A switchable lever comprising:

a first lever;

a second lever pivotably mounted to the first lever; and, a coupling assembly configured to selectively lock the second lever to the first lever, the coupling assembly configured to be actuated to one of a first, locked position or a second, unlocked position from a first side of the switchable lever; and, the coupling assembly configured to be actuated to a same one of the first, locked position or the second, unlocked position from a second side of the switchable lever.

2. The switchable lever of claim 1, wherein the coupling assembly comprises:

at least one push pin; and, a coupling pin arranged to be actuated by the at least one push pin.

3. The switchable lever of claim 2, wherein the coupling assembly further comprises a bias spring.

4. The switchable lever of claim 2, wherein a receiving land is formed at an actuated end of the coupling pin, the receiving land configured to engage a cam form on a second end of the at least one push pin.

5. The switchable lever of claim 4, wherein at least a portion of the cam form is increasing in width moving directionally from the second end to a first end of the at least one push pin.

6. The switchable lever of claim 4, wherein the coupling pin has a first locking surface at an end opposite the actuated end.

7. The switchable lever of claim 2, wherein the at least one push pin is a single push pin disposed within a through-bore, the single push pin arranged on one of the first side or the second side of the switchable lever.

8. The switchable lever of claim 2, wherein the at least one push pin is arranged to move longitudinally within a first bore and the coupling pin is arranged to move longitudinally within a second bore.

9. The switchable lever of claim 8, wherein the second bore intersects the first bore.

10. The switchable lever of claim 8, wherein the first bore forms an angle with the second bore, the angle ranging from 85 to 95 degrees.

11. The switchable lever of claim 8, wherein the first bore and the second bore are arranged within the first lever.

12. The switchable lever of claim 2, wherein the at least one push pin comprises a first push pin and a second push pin, both arranged to move longitudinally within a first bore.

13. The switchable lever of claim 12, wherein the first push pin and the second push pin are horizontally opposed to each other.

14. The switchable lever of claim 12, wherein the one of the first, locked position or the second, unlocked position is achieved by moving the first push pin within the first bore in a first direction and by moving the second push pin within the first bore in a second direction, opposite the first direction.

15. A switchable lever comprising:

a first lever;

a second lever pivotably mounted to the first lever; and, a coupling assembly configured to selectively lock the second lever to the first lever, the coupling assembly configured to be actuated to one of a first, locked position or a second, unlocked position by moving the coupling assembly in a first direction; and, the coupling assembly configured to be actuated to a same one of the first, locked position or the second, unlocked position by moving the coupling assembly in a second direction, opposite the first direction.

16. The switchable lever of claim 15, wherein the coupling assembly comprises a first push pin and a second push pin, both arranged to move longitudinally within a first bore.

17. The switchable lever of claim 16, wherein the coupling assembly further comprises a coupling pin arranged to be actuated by one of the first push pin or the second push pin.

18. The switchable lever of claim 17, further comprising a second bore, the coupling pin configured to move longitudinally within the second bore.

19. The switchable lever of claim 18, wherein the second bore intersects the first bore.

20. A switchable lever comprising:

a first lever;

a second lever pivotably mounted to the first lever;

a coupling assembly configured to selectively lock the second lever to the first lever; and when the switchable lever is arranged in a first location within a valve train of an internal combustion engine, a first side of the switchable lever is configured to be engaged with a first electronically controlled actuator arranged to move the coupling assembly to one of a first, locked position or a second, unlocked position; and, when the switchable lever is arranged in a second location within the valve train of the internal combustion engine, a second side of the switchable lever is configured to be engaged with a second electronically controlled actuator arranged to move the coupling assembly to a same one of the first, locked position or the second, unlocked position.

* * * * *